US011215024B2

(12) United States Patent
Mahjoub et al.

(10) Patent No.: US 11,215,024 B2
(45) Date of Patent: Jan. 4, 2022

(54) TOOL WITH PROPELLANT SECTIONS

(71) Applicant: SPEX CORPORATE HOLDINGS LTD., Aberdeen (GB)

(72) Inventors: Nadir Mahjoub, Aberdeenshire (GB); Jamie Oag, Westhill Aberdeenshire (GB); Rae Younger, Ellon Aberdeenshire (GB); Sidney Dantuma Johnston, Aberdeenshire (GB)

(73) Assignee: SPEX CORPORATE HOLDINGS LTD., Aberdeen (GB)

( * ) Notice: Subject to any disclaimer, the term of this patent is extended or adjusted under 35 U.S.C. 154(b) by 416 days.

(21) Appl. No.: 16/071,163

(22) PCT Filed: Jan. 19, 2017

(86) PCT No.: PCT/GB2017/050129
§ 371 (c)(1),
(2) Date: Jul. 19, 2018

(87) PCT Pub. No.: WO2017/125745
PCT Pub. Date: Jul. 27, 2017

(65) Prior Publication Data

US 2020/0284114 A1 Sep. 10, 2020

(30) Foreign Application Priority Data

Jan. 19, 2016 (GB) ..... 1601009

(51) Int. Cl.
*E21B 29/02* (2006.01)
*E21B 33/134* (2006.01)

(52) U.S. Cl.
CPC ..... *E21B 29/02* (2013.01); *E21B 33/134* (2013.01)

(58) Field of Classification Search
CPC ..... E21B 29/02
See application file for complete search history.

(56) References Cited

U.S. PATENT DOCUMENTS 2,935,020 A 5/1960 Howard et al.
3,053,182 A * 9/1962 Christopher ..... B26F 3/04 175/4.6

(Continued)

FOREIGN PATENT DOCUMENTS

GB 2175674 A 12/1986
WO 2016/139481 A1 9/2016

OTHER PUBLICATIONS

Combined Search and Examination Report for corresponding UK Patent Application No. 1700940.8, dated Jan. 19, 2018, pp. 1-9.

(Continued)

*Primary Examiner* — Cathleen R Hutchins
*Assistant Examiner* — Ronald R Runyan
(74) *Attorney, Agent, or Firm* — Tarolli, Sundheim, Covell & Tummino LLP

(57) ABSTRACT

A tool for manipulating a tubular. The tool comprising a plurality of tool sections arranged in a stack, each tool section comprising a propellant source having an upper surface and lower surface, the upper and lower surfaces being separated by an outer surface extending around the perimeter of the propellant source, a first flame retardant material being associated with the propellant source upper surface and a second flame retardant material being associated with the propellant source lower surface. The tool further comprises at least one modifying agent provided in or adjacent the tool sections or generated by the tool sections; and an ignition mechanism for igniting the propellant source outer surface of each tool section, such that upon ignition, each propellant source is adapted to deflagrate, creating a stream of combustion products, the stream of combustion products extending around, and flowing away from, the outer surface of said propellant source.

20 Claims, 9 Drawing Sheets

(56) References Cited

U.S. PATENT DOCUMENTS

| | | | | |
|---|---|---|---|---|
| 3,318,395 | A | 5/1967 | Messmer | |
| 4,798,244 | A | 1/1989 | Trost | |
| 6,024,169 | A | 2/2000 | Haugen | |
| 9,038,713 | B1 * | 5/2015 | Bell | F42B 1/028 166/55.7 |
| 2009/0183916 | A1 | 7/2009 | Pratt et al. | |
| 2014/0262328 | A1 | 9/2014 | Robertson | |
| 2015/0361759 | A1 | 12/2015 | Kjørholt et al. | |
| 2016/0010414 | A1 | 1/2016 | Bell et al. | |

OTHER PUBLICATIONS

Examination Report under Section 18(3) for corresponding UK Application No. 1700940.8, dated Apr. 12, 2018, pp. 1-4.

Examination Report under Section 18(3) for corresponding UK Application No. 1700940.8, dated Jun. 25, 2018, pp. 1-3.

PCT International Search Report and Written Opinion for International Application No. PCT/GB2017/050129, dated Jun. 16, 2017, pp. 1-23.

* cited by examiner

TOOL WITH PROPELLANT SECTIONS

RELATED APPLICATIONS

The present application is a U.S. National Stage application under 35 USC 371 of PCT Application Serial No. PCT/GB2017/050129, filed on 19 Jan. 2017; which claims priority from GB Patent Application No. 1601009.2, filed 19 Jan. 2016, the entirety of both of which are incorporated herein by reference.

FIELD

The present invention relates to a tool for manipulating a tubular, such as casing or production tubing. Particularly, embodiments of the present invention relate to a tool for stripping casing and cement in a well abandonment operation.

BACKGROUND

There are situations in which it is desirable to remove a portion of casing or tubing from an oil or gas well. A typical situation may be to remove a length of casing to allow a permanent cement plug to be installed, prior to well abandonment. Current Oil and Gas UK Guidelines for the Abandonment of Wells (July 2015, Issue 5) dictate that a permanent barrier, typically a cement plug, must be formed between the reservoir and the seabed to act as one of a number of permanent barriers when a well is abandoned or plugged. This measure is intended to isolate the well and reduce the possibility of pressure migration in order to prevent hydrocarbons and other well fluids from underground reservoirs leaking past the barrier(s) and coming to surface and spilling into the sea.

In some situations, prior to installing the cement plug to abandon or plug the well, it is necessary to remove the production tubing, casing and other downhole tubulars, and the cement and other downhole fixings that secure the well to the bedrock.

Casing may also be removed to undertake a casing repair, or to expose the cement behind the casing to allow cement repair. In some cases, where cemented casing is used, for example, there may be a leak path in the cement behind the casing or between casing layers. Rectifying such a breach may also require the removal of a casing section and associated cement before forming new cement and repairing the casing.

Conventional removal of cemented casing uses, for example, milling tools or hydro-abrasive cutters which remove the casing and associated cement by gradually cutting or milling away small portions of metal and cement. These are slow processes and therefore make such an operation very expensive and time consuming.

Perforating charges have also historically been used to penetrate a casing wall, to allow fluid communication through the casing wall and to allow cementing behind. Perforations only produce small holes through the target, whereas large holes are often desirable.

International patent application number PCT/GB2015/053507, describes a tool which, in some embodiments, utilises propellant and a modifying agent to strip sections of casing. In embodiments of this tool, there is a need for relative movement between the tool and the casing to be stripped. In some circumstances this may not be possible or practical.

SUMMARY

According to a first aspect of the present invention there is provided a tool for manipulating a tubular, the tool comprising:

a plurality of tool sections, each tool section comprising a propellant source having an upper surface and lower surface, the upper and lower surfaces being separated by an outer surface extending around the perimeter of the propellant source, a first flame retardant material being associated with the propellant source upper surface and a second flame retardant material being associated with the propellant source lower surface;

at least one modifying agent provided in or adjacent the tool sections or generated by the tool sections; and an ignition mechanism for igniting the propellant source outer surface of each tool section, such that upon ignition, each propellant source is adapted to deflagrate, creating a stream of combustion products, the stream of combustion products extending around, and flowing away from, the outer surface of said propellant source, wherein the tool sections are arranged in a stack.

In at least one embodiment of the invention, where it is desired to remove a length of wellbore casing and the associated cement holding it in place, a tool is provided which, through a series of tool sections, uses a number of streams of combustion products created by deflagration of a propellant source combined with a modifying agent, each tool section removing a section of the length of the wellbore casing/cement by, for example, ablation, displacement, removal, heating, abrasion or erosion. The tool sections combine to remove the required length of wellbore casing/cement.

A propellant is an explosive material which has a low rate of combustion and once ignited burns or otherwise decomposes to produce propellant gas. This gas is highly pressurised, the pressure driving the gas and other combustion products away from the propellant, forming a stream of combustion products. A propellant can burn smoothly and at a uniform rate after ignition without depending on interaction with the atmosphere, and produces propellant gas on combustion and may also produce heat and/or additional combustion products.

In use, the/each stream of combustion products and/or the modifying agent may erode, ablate, abrade, displace, heat or remove at least a portion of the tubular to be manipulated.

In use, the/each stream of combustion products may heat the tubular to be manipulated and the modifying agent may impinge at least a portion of the tubular to be manipulated, transferring energy to the tubular to be manipulated.

At least a portion of the tubular to be manipulated may be forcibly displaced or moved by the/each stream of combustion products and/or the modifying agent which impinge the tubular.

At least a portion of the tubular to be manipulated may be fractured, fragmented or cracked by the/each stream of combustion products and/or the modifying agent which impinge the tubular.

The propellant source may comprise a plurality of propellants.

Where there is a plurality of propellants, each propellant may deflagrate separately.

Where the propellant source comprises a plurality of propellants, at least one propellant may have a different function to at least one of the other propellants. For example, one propellant may heat the tubular to be manipulated and another propellant may erode, ablate, abrade or remove the tubular to be manipulated.

In at least one embodiment of the tool the/each stream of combustion products may be generated without generating heat or with minimal heat generation. Certain types of propellant can deflagrate without generating heat and the risk of igniting flammable materials that may be in close proximity to the/each stream of combustion products is reduced or eliminated. Additionally, minimal heat generation reduces damage to the tool.

The propellant source may comprise a solid propellant.

Alternatively or additionally, the propellant source may comprise a liquid, paste, foam or gel propellant.

The propellant source may be wholly contained within the housing.

In alternative embodiments, the propellant source may be fed into the housing. Feeding the tool with propellant allows the tool to be used continuously. The propellant source may be fed into the housing in the form of a solid, liquid, paste, foam, gel or gas or a combination of these.

The propellant source may be fed into the housing either continuously or intermittently.

The propellant source may be formed by combining two or more materials within the tool.

The propellant source may be arranged to create an intermittent stream of combustion products.

The propellant source may be a single state, a solid, liquid, paste, foam, gel or gas or may be in two or more states.

Alternatively the propellant source may comprise propellants in separate states, which are combined at or prior to deflagration initiation.

Alternatively or additionally the propellant sources may change state prior to ignition.

Once ignited, the propellant source may define a deflagration zone.

As the propellant source deflagrates, the deflagration zone may move relative to the tubular to be manipulated.

The spacing between the upper and lower propellant source surfaces may be less than the distance between the propellant source outer surface and a tool longitudinal axis.

The spacing between the upper and lower surfaces may be 50% less than the distance between the outer surface and a tool longitudinal axis.

The spacing between the upper and lower surfaces may be 75% less than the distance between the outer surface and a tool longitudinal axis.

Each propellant source may be a disk.

Where the propellant source is a disk, the upper and lower surfaces may be aligned, in use, perpendicular to a wellbore axis. Such an arrangement ensures the stream of combustion products flows towards the wellbore surfaces.

Alternatively, each propellant source may be frusto conical. A slight frusto-conical shape angles the combustion products slightly below the horizontal causing the manipulated material to be pushed out of the way more easily.

Each tool section may define a throughbore. Such an arrangement permits the tool sections to be mounted on to a mandrel and run into a wellbore, for example.

The stream of combustion products from one tool section may overlap the stream of combustion products from an adjacent section.

Each tool section may define an outlet, each tool section being arranged such that the stream of combustion products flows through the outlet.

The outlet may be arranged such that the stream of combustion products impinges on the outlet.

The outlet may be a nozzle.

Particularly the outlet may be a divergent nozzle.

The outlet may be sacrificial.

In alternative embodiments the outlet may have a sacrificial coating.

The outlet or the sacrificial coating may be at least one of the at least one modifying agents.

The outlet may be adjustable to allow the size of a nozzle outlet gap to be adjusted or, where the outlet is sacrificial, to be maintained.

The outlet may be adjustable by, for example, self-adjusting. In some embodiments the outlet may self-regulate to maintain the outlet gap using a self-loaded spring for example.

The outlet may be continuous.

The outlet may be cooled.

Each tool section may include a housing.

Each housing may include an upper section and a lower section, the housing upper section being adjacent a propellant source upper surface and the housing lower section being adjacent a propellant source lower surface.

The housing may comprise two parallel plates.

The housing may comprise parallel steel disks.

The housing may define the outlet.

The tool may comprise an isolation mechanism to isolate a section of tubular to be manipulated. The isolation mechanism could be used to allow material, such as well fluids and water, to be driven out of the isolated section, further increasing the efficiency of the tool.

The outlet may, in use, be arranged to direct the stream of combustion products to manipulate an area of tubular.

The area of tubular, in use, may extend around the internal circumference of the tubular.

The height of the area of tubular may be greater than the spacing between the propellant source upper and lower surfaces.

The height of the area of tubular at the surface of the tubular to be manipulated may be greater than the spacing between the propellant source upper and lower surfaces. Having an overlap ensures the tubular is fully manipulated.

The tool sections may be ignited sequentially. Sequential ignition allows the manipulation of one area of tubular to be complete before the manipulation of another area of tubular by another tool section commences.

In some embodiments the tool sections may be ignited in series.

In a preferred embodiment the tool sections are ignited in series and sequentially.

At least one modifying agent may be formed by the deflagration of the propellant source.

Alternatively or additionally, at least one modifying agent may be formed separately from the deflagration of the propellant source.

Alternatively or additionally, at least one modifying agent may be present prior to ignition of the propellant source.

The/each modifying agent may be solid, liquid and/or gas or any combination thereof.

At least one modifying agent may be contained within the propellant source. For example the at least one modifying agent may be exposed as the propellant source deflagrates.

In at least one embodiment at least one modifying agent introduces new chemicals to the deflagration process.

In at least one embodiment at least one modifying agent reacts with the propellant constituent(s).

In at least one embodiment at least one modifying agent may react as a result of the combustion temperature.

In at least one embodiment at least one modifying agent may react with the combustion products and/or each stream of combustion products.

In at least one embodiment at least two modifying agents may react with each other.

In at least one embodiment at least one modifying agent may react with the environment and/or the target material(s).

In at least one embodiment at least one modifying agent may influence the deflagration process.

In at least one embodiment at least one modifying agent may change state during and/or after the deflagration process.

In at least one embodiment at least one modifying agent may be introduced into the propellant gas and/or combustion products.

In at least one embodiment at least one modifying agent may be drawn into the propellant gas and/or stream of combustion products by a venturi or similar geometric profile.

In at least one embodiment at least one modifying agent may be mechanically or forcibly introduced into the propellant gas and/or stream of combustion products.

In at least one embodiment at least one modifying agent may already be present in the tubular to be manipulated.

In at least one embodiment of the present invention at least one modifying agent may include solid particles. Solid particles can cause abrasion of the material to be manipulated.

Alternatively or additionally at least one modifying agent may contain liquid droplets. Liquid droplets can cause erosion of the material to be manipulated.

The liquid droplets may be explosive and may explode on impact with the target. In at least one embodiment of the present invention explosive liquid droplets increase the penetrating power of the/each stream of combustion products and/or additional materials.

In at least one embodiment of the present invention at least one modifying agent may include a chemical etching compound. In at least one embodiment of the present invention a chemical etching compound may complement the eroding power of the/each stream of combustion products and/or additional materials by reacting with the target material.

The modifying agent may become part of the/each stream of combustion products within the tool section.

The modifying agent may become part of the/each stream of combustion products outwith the tool section.

The modifying agent may be applied to the surface of the tubular to be manipulated.

In some embodiments, the modifying agent may be a flux. The flux may be applied to the surface of the tubular to be manipulated providing a method of transferring heat from the/each stream of combustion products to the tubular to be manipulated material.

When the tool sections are ignited in series and sequentially, the lowest tool section may be ignited first.

The ignition mechanism may be arranged such that the deflagration of the propellant source of one section ignites the propellant source of the next tool section.

At least one of the propellant sources may comprise a plurality of propellants. As the propellant sources deflagrate, the diameter of each propellant source may reduce, thereby reducing the surface area available to be deflagrated. Furthermore, as the diameter reduces, the distance of the deflagration surface from the material to be manipulated increases. Using a number of propellants of different types can help overcome these problems.

The propellants may be arranged concentrically. Concentric rings of propellant of different qualities can be used to counter the problems of diameter reduction.

Alternatively the propellants may be arranged in layers. Layers of propellant can also be used to counter the problems of diameter reduction as the deflagrating outer surface can extend in between the layers, utilising additional surface area.

The outlet(s) may be sealed.

In at least one embodiment, the outlet(s) may be sealed by an opening mechanism.

The opening mechanism may be adapted to open the outlet(s) in response to an environmental condition being reached. For example, the opening mechanism may be adapted to open the outlet(s) when pressure inside the tool housing reaches a certain level. This may be useful where, for example, the environmental pressure outside the tool housing is higher than the pressure within the tool housing prior to ignition of the propellant source. Providing a sealed outlet prevents fluid in the environment surrounding the tool from entering tool through the outlet. Upon ignition of the propellant source, the pressure inside the housing rises and at a threshold pressure, higher than the environmental pressure, the outlet(s) can open allowing the/each stream of combustion products to exit the outlet(s).

The opening mechanism may comprise a frangible portion. The frangible portion may be adapted to break or shear at a threshold pressure.

In alternative embodiments, the opening mechanism may be adapted to open in response to a signal, for example from surface.

BRIEF DESCRIPTION OF THE DRAWINGS

Embodiments of the present invention will now be described with reference to the accompanying drawings in which.

DETAILED DESCRIPTION OF THE DRAWINGS

Figure 1:
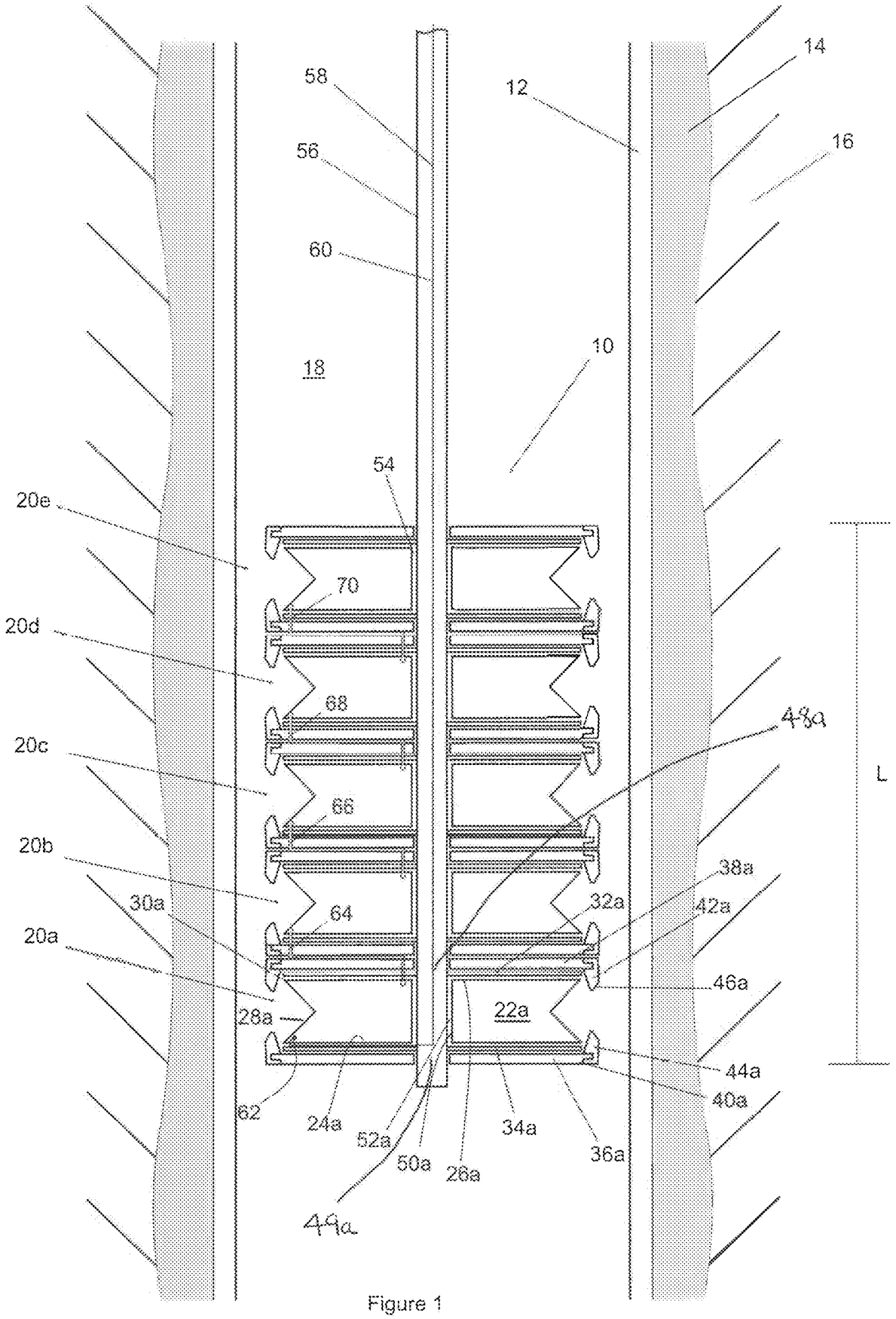
FIG. 1 is a section of a tool for stripping a length of wellbore casing and associated cement back to bare rock to allow a wellbore plug to be fitted to seal the wellbore in accordance with a first embodiment of the present invention.

Reference is first made to FIG. 1 a section of a tool, generally indicated by reference numeral 10, for stripping a length (indicated by the letter "L") of wellbore casing 12 and associated cement 14 back to bare rock 16 to allow a wellbore plug (not shown) to be fitted to seal the wellbore 18, in accordance with a first embodiment of the present invention.

The tool 10 comprises a plurality of tool sections 20*a-e*. As will be shown each tool section 20 strips a section of the length L of casing 12 and cement 14, the tool sections 20 combining to strip the entire length L of casing 12 and cement 14.

The tool sections 20*a-e* have similar constructions and the first tool section 20*a* will now be described.

The first tool section 20*a* comprises a propellant source 22*a* in the form of a ring defining an upper surface 26*a* and a lower surface 24*a*, the upper and lower surfaces 26*a*, 24*a* being parallel and linked by a propellant source defined outer surface 28*a* extending around the perimeter 30*a* of the propellant source 22*a* and a propellant source inner surface 50*a* bounding a propellant source throughbore 52*a*.

Embedded within the propellant source 22*a* is a modifying material (not shown) in the form of metal particles. The purpose of these particles will be discussed in due course.

The first tool section 20*a* further comprises a first sheet 32*a* of a rubber flame retardant material adhered to the propellant source upper surface 26*a* and a second sheet 34*a* of a rubber flame retardant material adhered to the propellant source lower surface 24*a*.

The first tool section 20*a* further comprises a housing 36*a*. The housing 36*a* comprise an upper steel disk 38*a* and a lower steel disk 40*a*, the steel disks 38*a*, 40*a* being parallel. Each of the steel disks 38*a*, 40*a* also define a throughbore 48*a*, 49*a*.

Attached to the upper and lower steel disks 38*a*, 40*a* are upper and lower circumferential lips 42*a*, 44*a* respectively. The circumferential lips 42*a*, 44*a* define a 360 degree divergent nozzle 46*a*.

When assembled each of the tool sections 20 define a throughbore 54, the tool section throughbore 54 being the combined throughbores 48, 49, 52 of the steel disks 38, 40 and the propellant source 22.

The tool 10 further comprises a mandrel 56 which passes through the tool section throughbores 54, forming a threaded connection with the housing of each of the tool sections.

The tool 10 additionally comprises an ignition mechanism 58 for igniting the propellant sources 22. The ignition mechanism 58 comprises an electronic initiator 60 which runs from a control location (not shown) to the outer surface 28*a* of the first tool section propellant source, the electronic initiator 60 terminating in a spark generator 62.

The ignition mechanism 58 further comprises four transfer ignitors 64,66,68,70 the first transfer ignitor 64 being positioned between the first tool section 20*a* and the second tool section 20*b*, the second transfer ignitor 66 being positioned between the second tool section 20*b* and the third tool section 20*c*, the third transfer ignitor 68 being positioned between the third tool section 20*c* and the fourth tool section 20*d*, and the fourth transfer ignitor 70 being positioned between the fourth tool section 20*d* and the fifth tool section 20*e*. The transfer ignitors 64, 66, 68, 70 are strips of propellant which provide a continuous connection between the tool sections 20, for transferring the flame/combustion zone from one tool section 20 to the next tool section 20, as will now be described.

Figure 2:
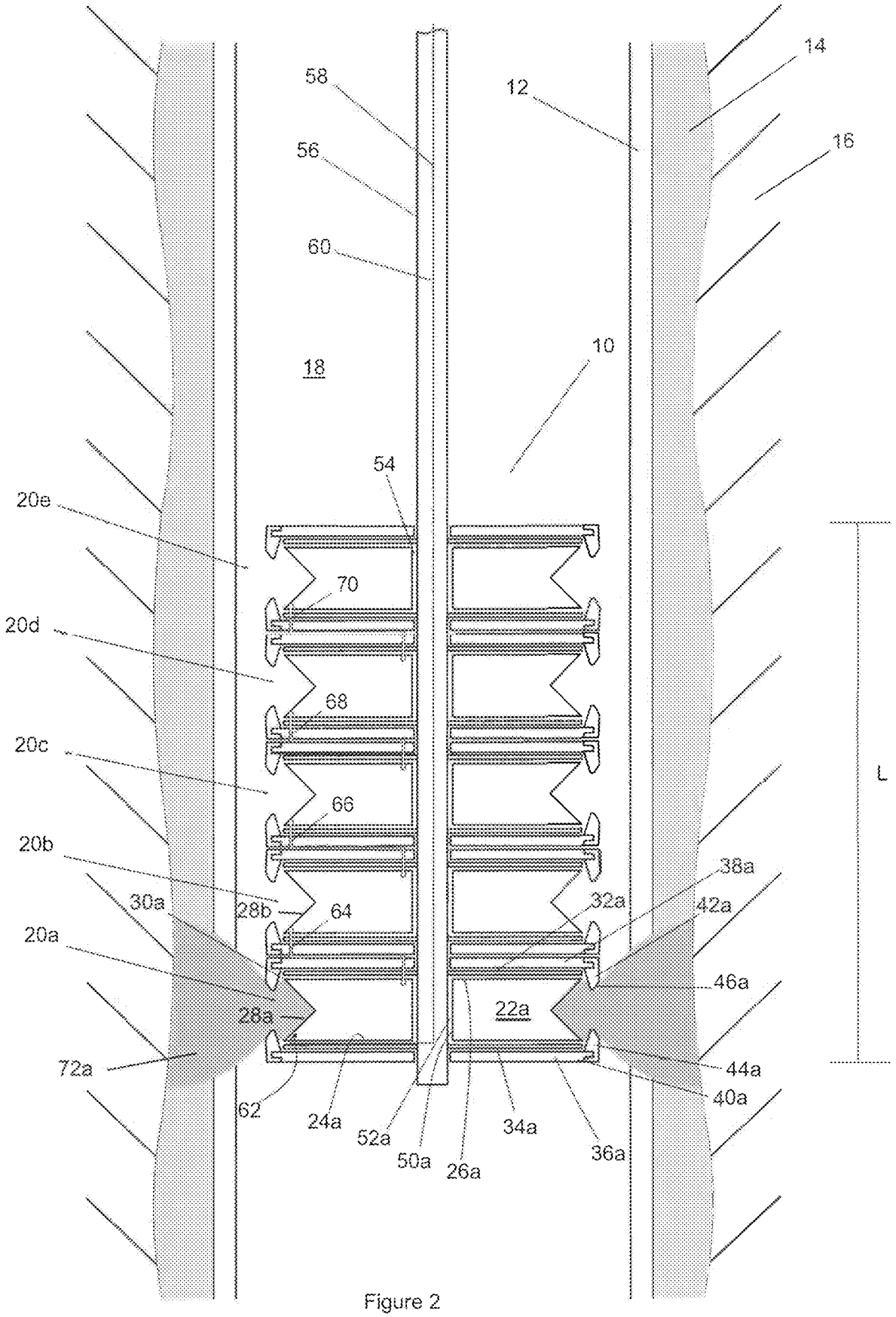
FIGS. 2, 3, 4 and 5 are section views showing the operation of the tool FIG. 1.

Referring to FIG. 2, a section through the tool 10 of FIG. 1, showing the ignition of the first tool section 20*a*, the ignition signal has been sent from above ground to the tool 10, through the electronic initiator 60. Particularly, the electronic initiator generates a spark which ignites the outer surface 28*a* of the propellant source 22*a* of the first tool section 20*a*.

The first tool section outer surface 28*a* is "V"-shaped to generate a stream of combustion products 72*a*, carrying the particles of metal modifying material (not shown), which passes through the divergent nozzle 46*a*.

The nozzle 46*a* spreads the stream of combustion products out and impacts the casing surface. The particles of metal within the stream of combustion products 72*a* are heated by the stream of combustion products. On impact these heated metal particles will transfer heat to the casing 12 allowing the casing 12 to be manipulated and removed, exposing the cement 14 which is then also removed stripping the wellbore 18 back to bare rock 16.

As the propellant source 22*a* deflagrates, the outer surface 28*a* recedes back towards the mandrel 56. Once the outer surface reaches the first transfer ignitor 64, the combustion travels along the transfer ignitor 64 to ignite the outer surface 28*b* of the second tool section 20*b*.

Figure 3:
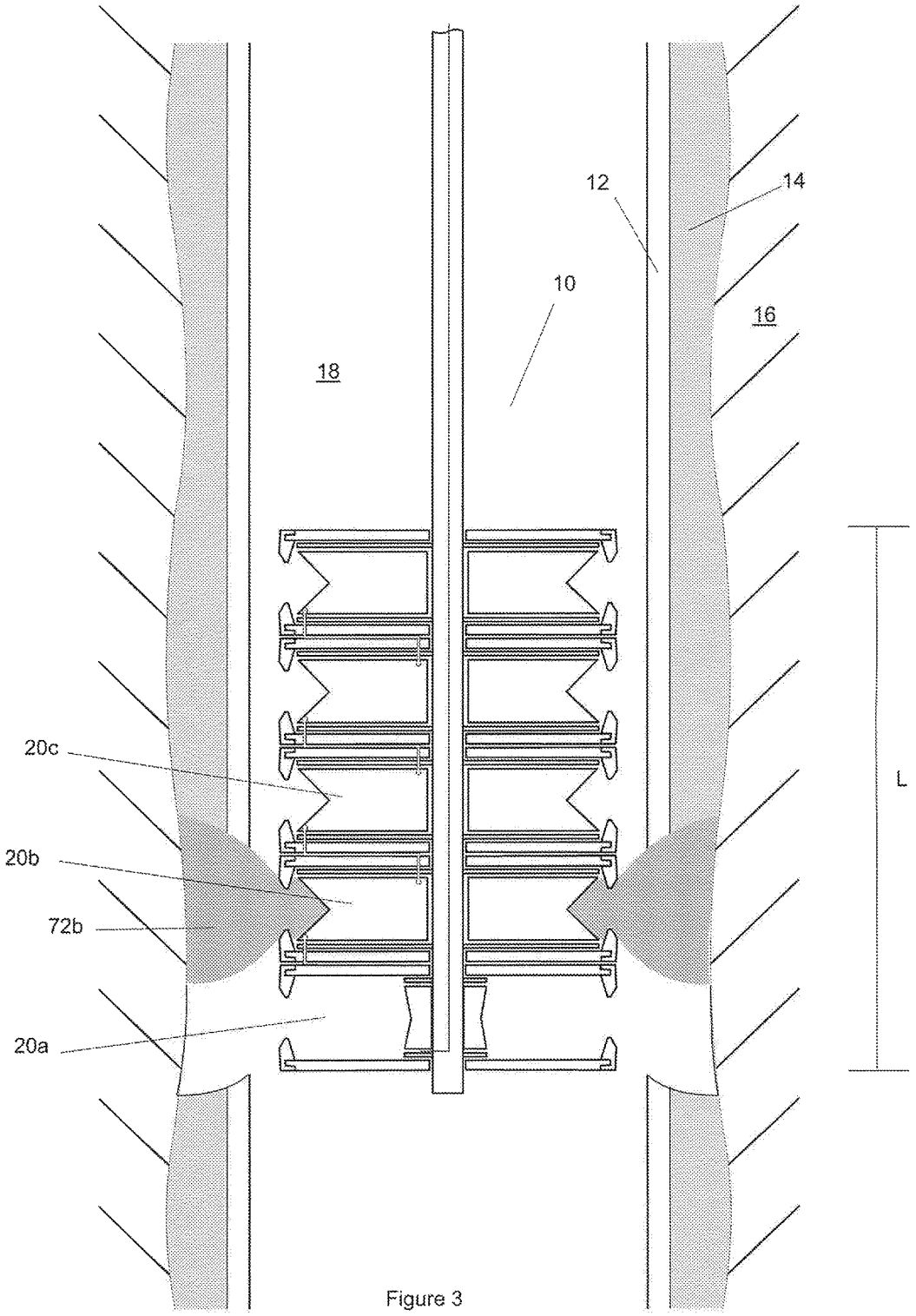

Reference is now made to FIG. 3, a section through the tool 10 of FIG. 1, showing the initiation of the second tool section 20*b*. This drawing shows that a portion of the casing 12 and cement 14 have been removed by the first tool section 20*a* and a stream of combustion products 72*b* from the second tool section is now attacking the next portion of casing 12 and cement 14. It will be understood that the same mechanism as before transfers the combustion from the second tool section 20*b* to the third tool section 20*c* and for subsequent sections thereafter.

Figure 4:
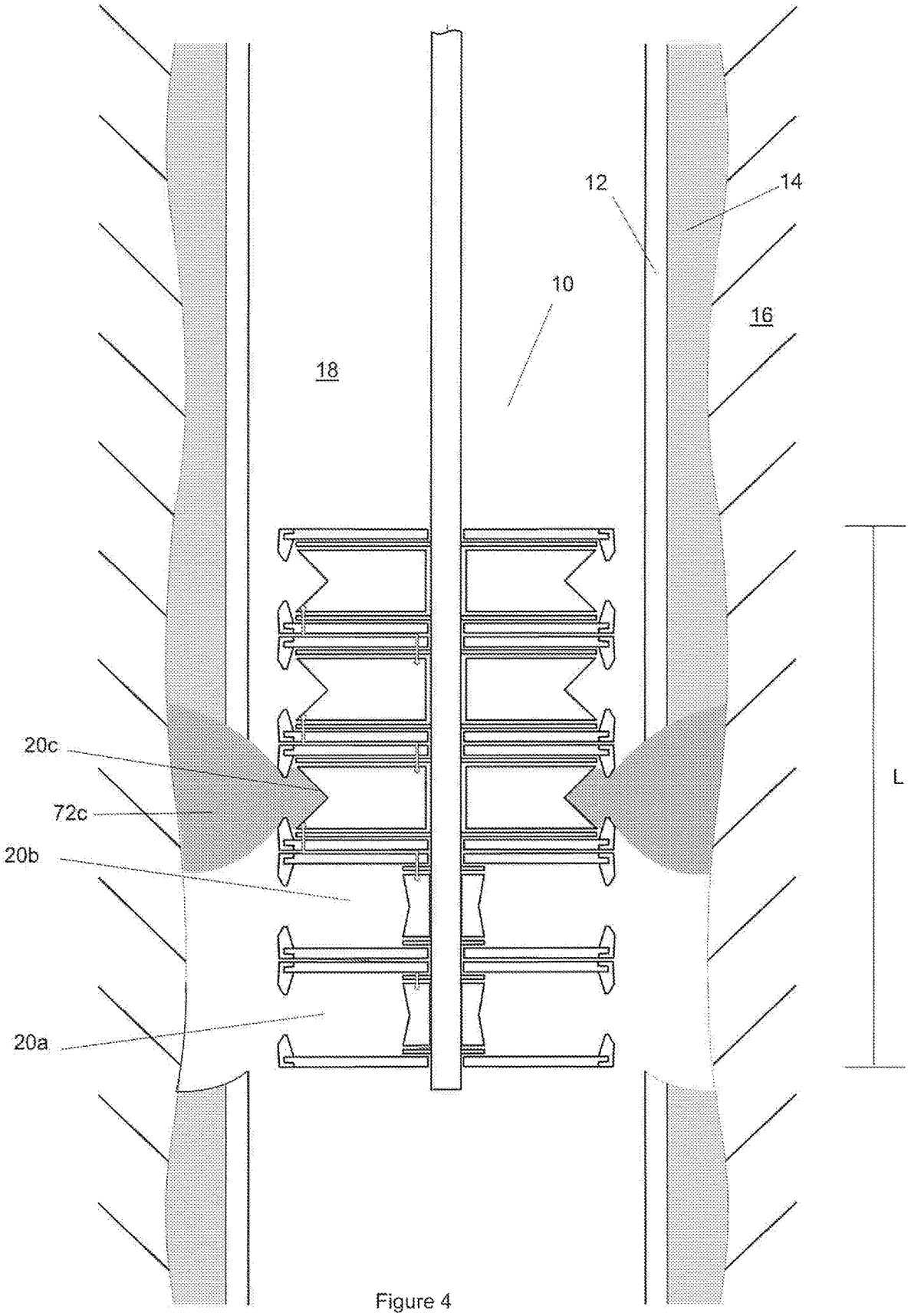

Reference is now made to FIG. 4, a section through the tool 10 of FIG. 1, showing the initiation of the third tool section 20*c*, This drawing shows further removal of the casing 12 and cement 14 by the second tool section 20*b* has been achieved and a stream of combustion products 72*c* from the third tool section is now attacking the next portion of casing 12 and cement 14.

Figure 5:
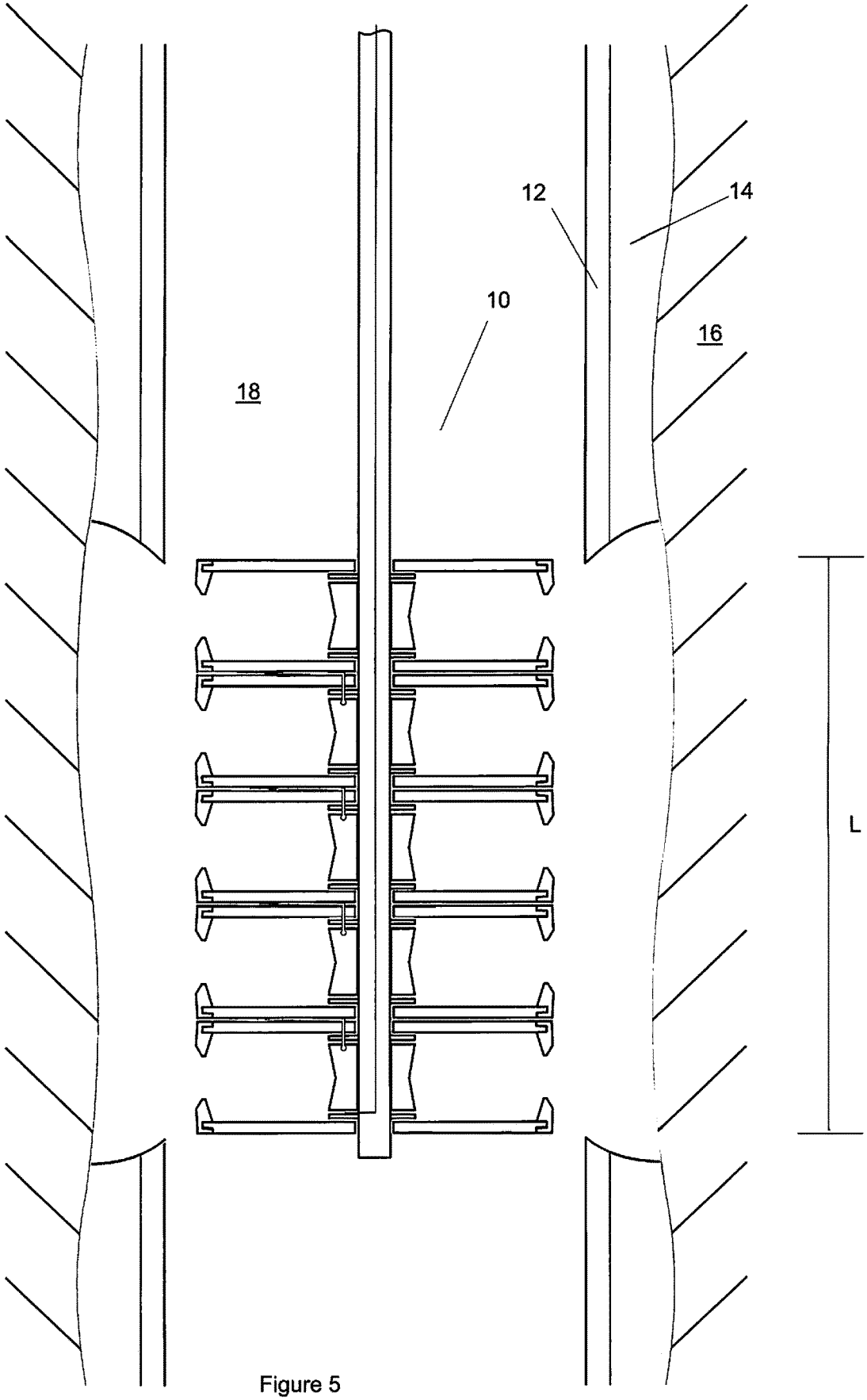

Reference is now made to FIG. 5, a section through the tool 10 of FIG. 1 at the completion of removal of casing 12 and cement 14 from the length L of the wellbore 18. As can be seen from this Figure, the wellbore 18 has been stripped back along the length L to bare rock 16. The tool 10 can now be removed or dropped and a plug set in place to allow the wellbore 18 to be abandoned.

Figure 6:
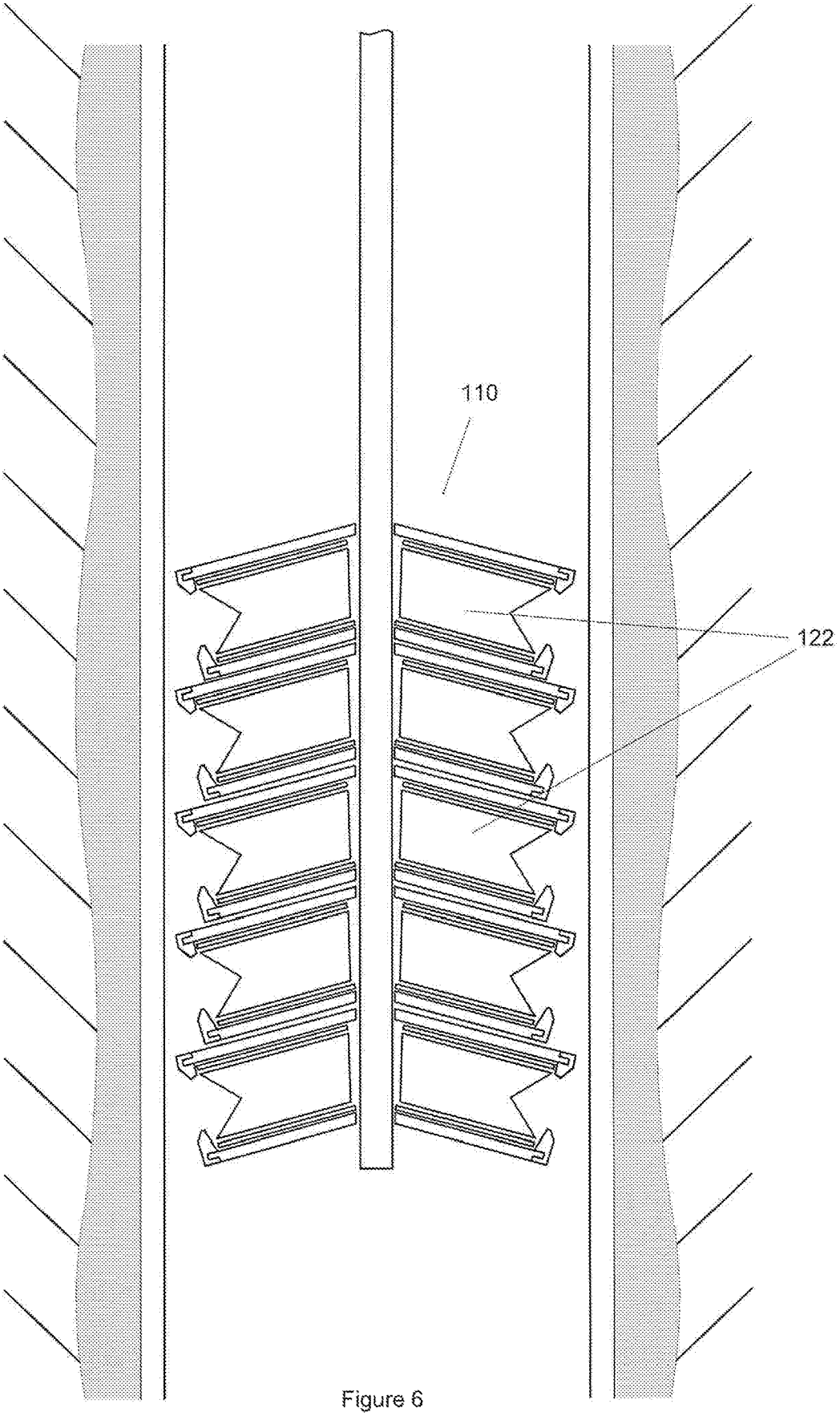
FIG. 6 is a section of a tool for stripping a length of wellbore casing and associated cement back to bare rock to allow a wellbore plug to be fitted to seal the wellbore in accordance with a second embodiment of the present invention.

Referring to FIG. 6, a tool 110 is shown according to a second embodiment of the present invention. This tool 110 is largely identical to the tool 10 of FIG. 1 other than the propellant sources 122 are frusto conical, creating a slight angle from the horizontal to the direction of flow of the stream of combustion products when the tool 110 is ignited. This allows for the stream of combustion products to push the manipulated material downwards. It is believed this will improve the removal of material from the length of wellbore to be stripped back to bare rock.

Figure 7:
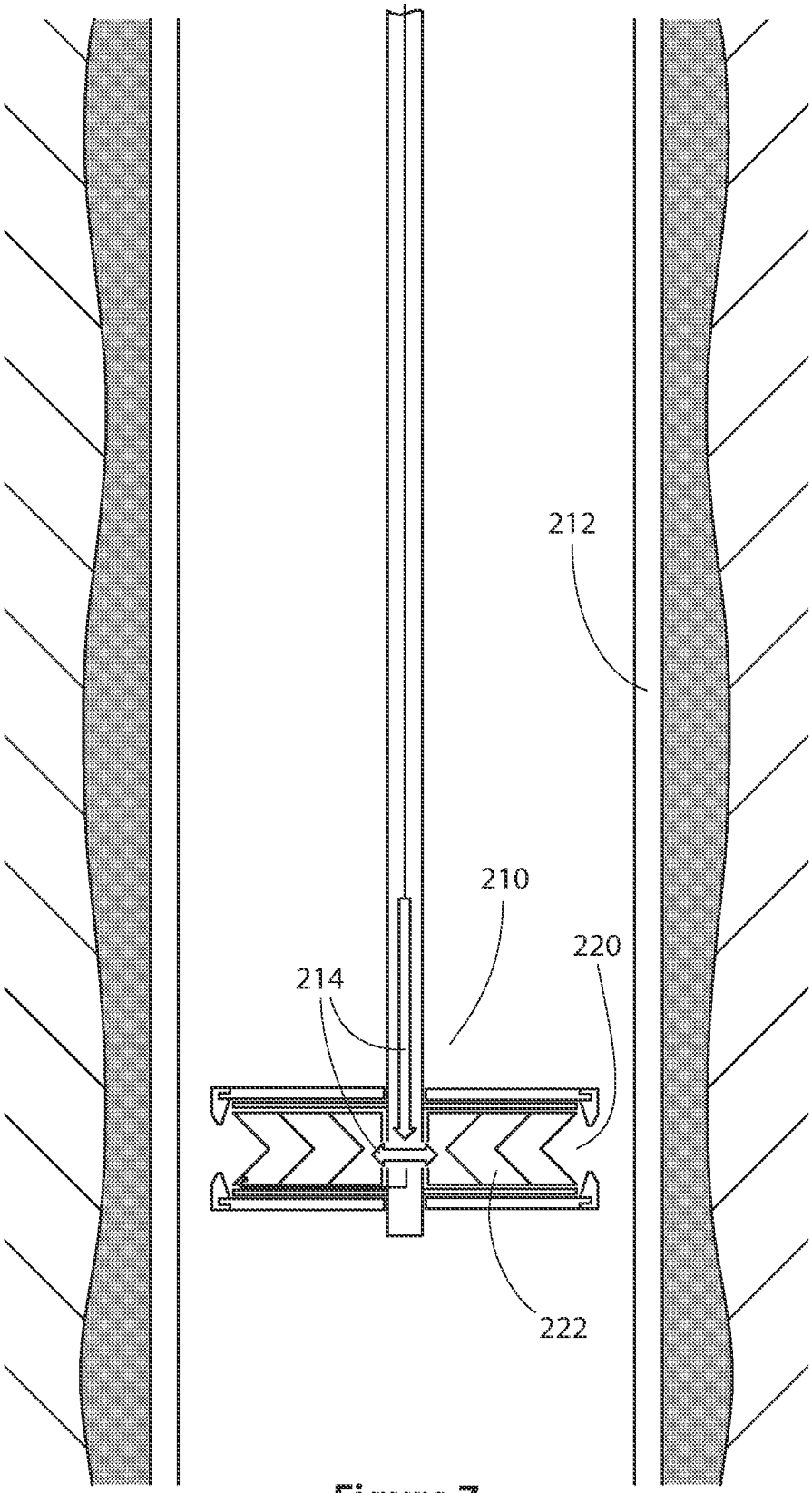
FIG. 7 is a section of a tool for stripping a length of wellbore casing and associated cement back to bare rock to allow a wellbore plug to be fitted to seal the wellbore in accordance with a third embodiment of the present invention.
Figure 8:
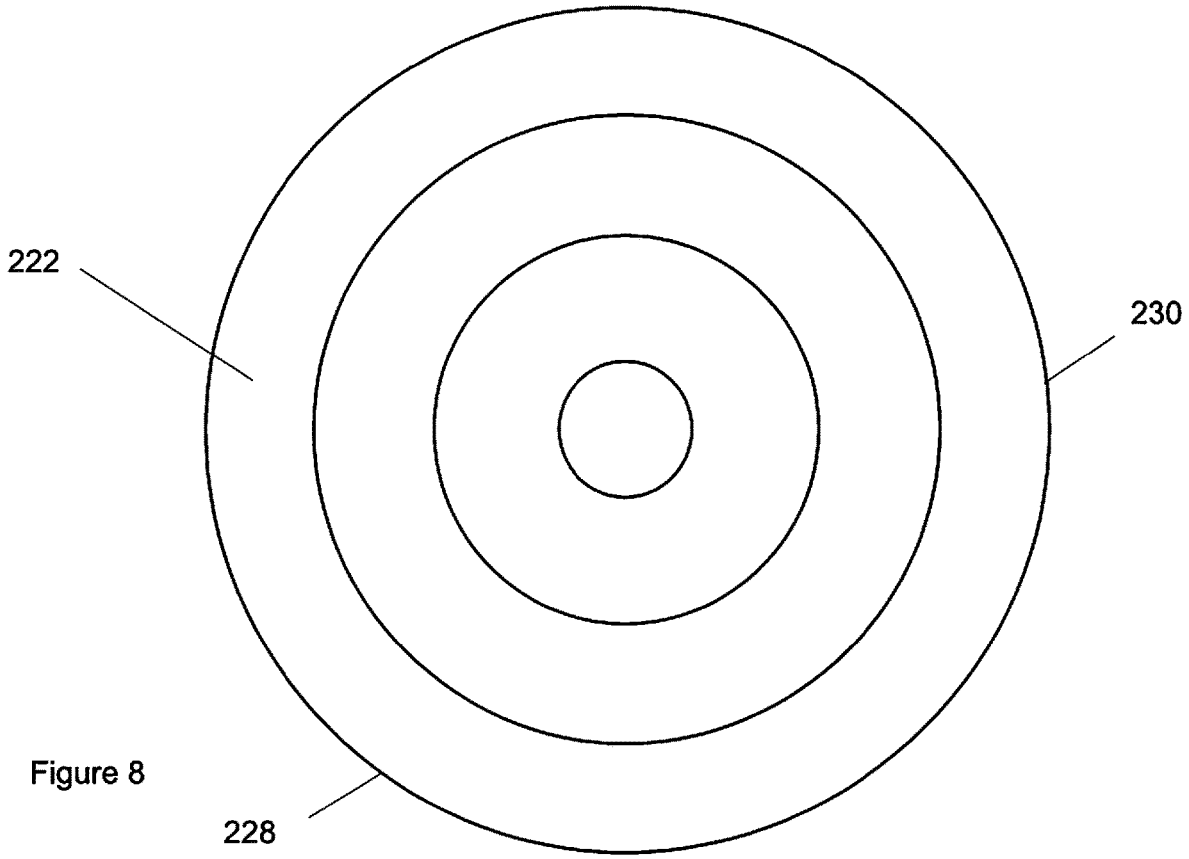
FIG. 8 is a plan view of the propellant source of the embodiment of FIG. 7.

Referring to FIG. 7, a tool 210 shown according to a third embodiment of the present invention. This tool 210 is largely identical to the tool 10 of FIG. 1 (although only one tool section 20 is shown) other than the propellant source 222 is made up of three different propellant materials. A plan view of the propellant source 222 can be seen in FIG. 8. This shows that the three different propellant materials are arranged concentrically.

As the propellant 222 burns the diameter of the propellant 222 decreases, resulting in a reduced surface outer surface 228 area and the distance from the perimeter 230 to the casing 212 increases. In this example, the propellant materials have progressively faster deflagration rates creating a stronger stream of combustion products to maintain the stripping capacity of the tool 210. As an alternative, propellant may be fed into the propellant source as indicated by arrows 214 in FIG. 7. Feeding of propellant may be continuous or intermittent.

Figure 9:
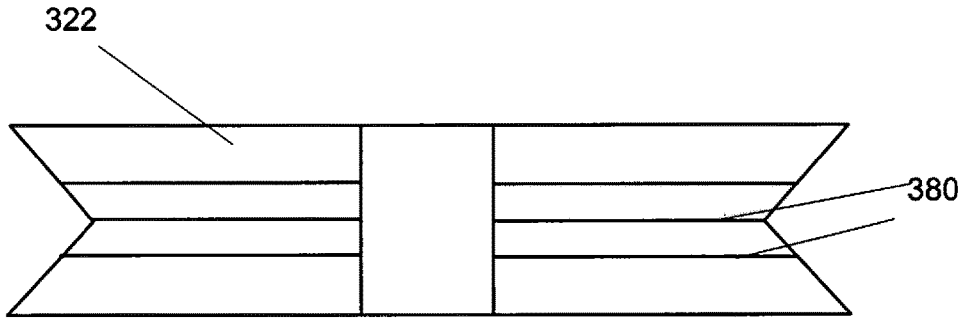
FIGS. 9, 10 and 11 are alternative structures propellant source according to further embodiments of the present invention.

An alternative structure of a propellant source 322 according to a fourth embodiment of the present invention is shown in FIG. 9. In this embodiment the propellant source 322 is made up of layers of propellant. Upon ignition of the propellant source 322, the deflagration not only occurs on the outer surface 328 of the propellant source 322 but along interfaces 380 between the layers. This increases the surface area of the deflagration.

Figure 10:
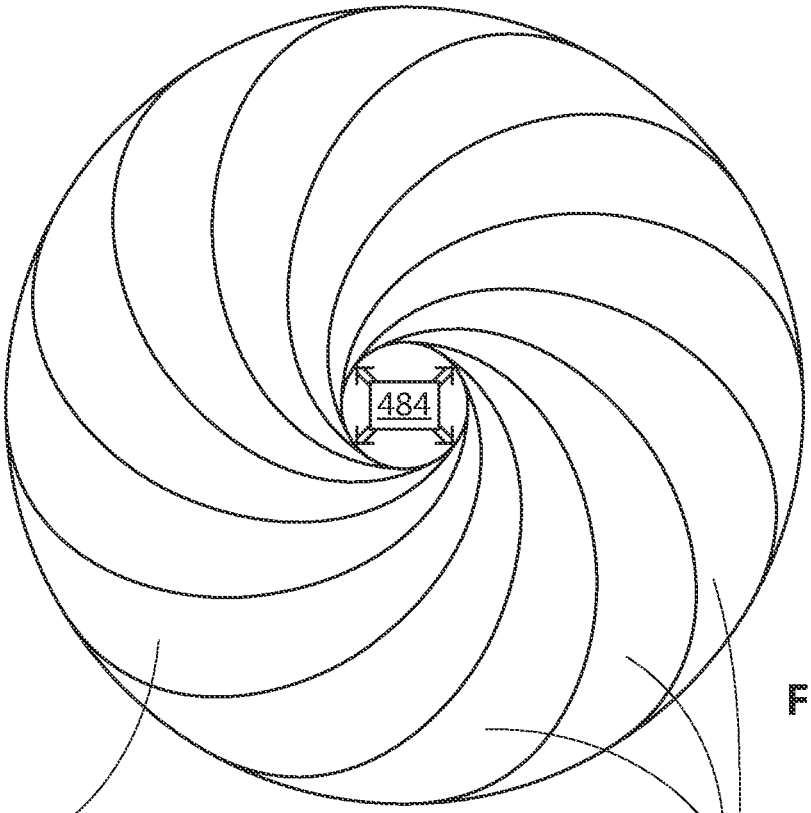
Figure 11:
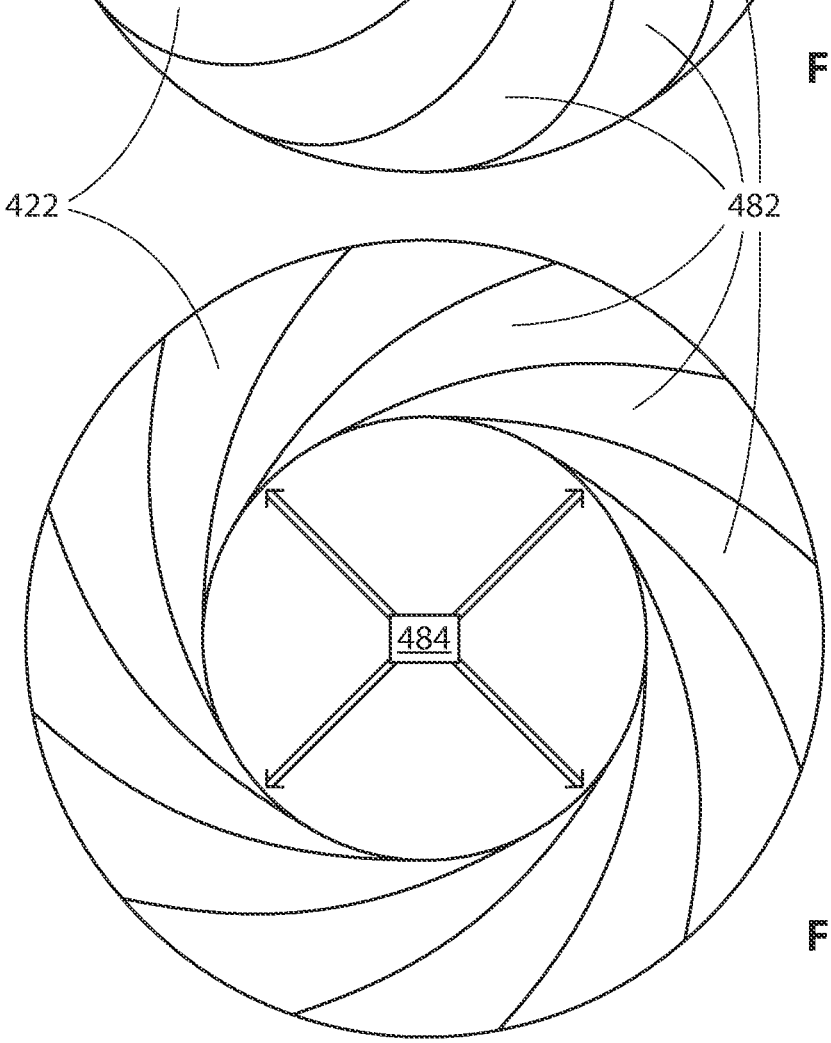

A further alternative structure of propellant source 422, according to a fifth embodiment of the present invention is shown in FIG. 10 and FIG. 11. The propellant source 422 comprises a series of wedges 482 which, as shown in FIG. 11, move and slide under the action of the spring mechanism 484 to maintain a constant external diameter of the propellant source 422.

The invention claimed is:

1. A tool for manipulating a tubular, the tool comprising:

a plurality of tool sections, each tool section comprising a propellant source having an upper surface and lower surface, the upper and lower surfaces being spaced apart and separated by an outwards facing outer surface extending around an outer perimeter of the propellant source between the upper and lower surfaces, a first flame retardant material being associated with the propellant source upper surface and a second flame retardant material being associated with the propellant source lower surface;

at least one modifying agent provided in or adjacent the tool sections or generated by the tool sections, the modifying agent being for at least one of transferring heat to, eroding, ablating, abrading, displacing, and removing at least a portion of the tubular to be manipulated; and an ignition mechanism for igniting the outwards facing outer surface of the propellant source of each tool section, such that upon ignition, propellant at each propellant source deflagrates, creating a stream of combustion products, the stream of combustion products extending around, and flowing away from, the outwards facing outer surface of said propellant source, wherein the tool sections are arranged in a stack, and wherein the ignition mechanism comprises transfer ignitors positioned between the tool sections of the plurality of tool sections, and an initiator which runs from a control location to the outwards facing outer surface of the propellant source of a first tool section of the plurality of tool sections whereby, following ignition of the outwards facing outer surface of the propellant source of the first tool section, at least one of the transfer ignitors ignites the outwards facing outer surface of a second tool section of the plurality of tool sections.

2. A tool according to claim 1, wherein each tool section comprises a housing and the propellant source is wholly contained within the housing.

3. A tool according to claim 1, wherein each tool section comprises a housing and the propellant for the propellant source is fed into the housing.

4. A tool according to claim 3, wherein the propellant for the propellant source is fed into the housing either continuously or intermittently.

5. A tool according to claim 1, wherein each propellant source is a disk.

6. A tool according to claim 5, wherein the propellant source is a disk, the upper and lower surfaces are aligned, in use, perpendicular to a wellbore axis.

7. A tool according to claim 1, wherein each propellant source is frusto conical.

8. A tool according to claim 1, wherein the stream of combustion products from one tool section overlaps the stream of combustion products from an adjacent section.

9. A tool according to claim 1, wherein each tool section includes a housing.

10. A tool according to claim 9, wherein each housing includes an upper section and a lower section, the housing upper section being adjacent a propellant source upper surface and the housing lower section being adjacent a propellant source lower surface.

11. A tool according to claim 10, wherein each of the upper section of the housing and the lower section of the housing comprises a plate, and the plates are parallel.

12. A tool according to claim 1, wherein each tool section defines an outlet, each tool section being arranged such that the stream of combustion products flows through the outlet, wherein the outlet is, in use, arranged to direct the stream of combustion products to manipulate an area of tubular.

13. A tool according to claim 12, wherein the area of tubular, in use, extends around the internal circumference of the tubular.

14. A tool according to claim 12, wherein the height of the area of tubular is greater than the spacing between the propellant source upper and lower surfaces.

15. A tool according to claim 12, wherein the height of the area of tubular at the surface of the tubular to be manipulated is greater than the spacing between the propellant source upper and lower surfaces.

16. A tool according to claim 1, wherein at least one of the propellant sources comprises a plurality of propellants.

17. A tool according to claim 1, wherein the propellants are arranged concentrically.

18. A tool according to claim 1, wherein the propellants are arranged in layers.

19. The tool of claim 1, wherein the propellant source comprises a body of propellant, the body of propellant defining a combustion surface including the outer surface of the propellant source, the body of propellant comprising a plurality of propellant sections, the propellants sections being relatively movable, in use, to maintain the position of the combustion surface constant relative to an external reference point as the body of propellant deflagrates.

20. The tool of claim 19, wherein the propellants sections being relatively movable, in use, maintain constant external diameter of the propellant source as the body of propellant deflagrates.

* * * * *